United States Patent [19]

Moss

[11] 4,078,572

[45] Mar. 14, 1978

[54] PORTABLE SHELTER

[76] Inventor: Charles W. Moss, Mill St., West Rockport, Me. 04856

[21] Appl. No.: 754,560

[22] Filed: Dec. 27, 1976

[51] Int. Cl.[2] ..... A45F 1/16

[52] U.S. Cl. ..... 135/1 R; D25/18; D88/3 B; 135/3 R; 135/15 CF

[58] Field of Search ..... 135/3 R, 1 R, 3 E, 15 CF; D88/18, 19, 3 B; 52/80

[56] References Cited

U.S. PATENT DOCUMENTS

| | | | |
|---|---|---|---|
| D. 230,724 | 3/1974 | Infante | 52/80 X |
| 2,948,287 | 8/1960 | Rupert | 135/1 R |
| 2,953,145 | 9/1960 | Moss et al. | 135/1 R |
| 2,976,876 | 3/1961 | Lonnqust | 135/3 E |
| 3,058,480 | 10/1962 | Blanchard | 135/3 E |
| 3,223,098 | 12/1965 | Dole, Jr. | 135/3 E |
| 3,533,202 | 10/1970 | Gellert | D25/18 X |
| 3,621,857 | 4/1970 | May et al. | 135/1 R |
| 3,699,986 | 10/1972 | Kirkham | 135/1 R |
| 3,802,133 | 4/1974 | Gregory | 52/86 |
| 3,834,410 | 9/1974 | Leibel | 135/3 E |
| 3,874,396 | 4/1975 | Kirkham | 135/1 R |

FOREIGN PATENT DOCUMENTS

| | | | |
|---|---|---|---|
| 1,373,418 | 8/1964 | France | 135/3 R |

OTHER PUBLICATIONS

The News (Mexico City), Tuesday, Oct. 21, 1969.
Time Magazine, July 26, 1976, "Moss, The Tentmaker".
North Face Catalog, 1975.

*Primary Examiner*—Werner H. Schroeder
*Assistant Examiner*—Conrad L. Berman
*Attorney, Agent, or Firm*—Olsen and Stephenson

[57] ABSTRACT

A tent that has three radially disposed alcoves, each with sufficient space to accommodate two people so that it can serve as a six-man tent. The frame is a free-standing vaulted pole system of fiber glass rods and aluminum tubing connected by ferrules or hub-like members, and the cover is a suitable light-weight flexible material which can be fitted on the frame assembly to be distended thereby. The aerodynamic design of the erected tent deflects heavy wind loads, and the light weight of the components and their compactness when disassembled provides a highly desirable back-pack tent for use by as many as six campers.

15 Claims, 5 Drawing Figures

PORTABLE SHELTER

BACKGROUND OF THE INVENTION

The present invention relates to tents particularly but not exclusively adapted to be transported as part of a back-pack for camping or recreational purposes.

The prior art relating to portable shelters or tents is highly developed. Many tents have been introduced to the market which serve very adequately their intended uses. However, the prior art has failed to meet the needs that have long existed for a tent that can be used for large group camping to provide adequate sleeping space for at least six people, and which is constructed and arranged to meet the needs of the campers for adequate accommodations for this number of campers while having characteristics that enable it to be carried easily as a back-pack by one individual, that can be erected with ease by one individual, that when erected will have an aerodynamic design to deflect heavy wind loads, and that will be a relatively low cost unit commensurate with a tent providing these desirable features.

SUMMARY OF THE INVENTION

The present invention has overcome the inadequacies of the prior art tents and provides an improved tent that meets the above recited needs.

According to one form of the present invention, a tent is provided which has a flexible cover having a centrally located vertical axis and defining when distended at least three alcoves disposed radially around the vertical axis. The alcoves have longitudinal axes intersecting the vertical axis and transverse cross sections of arch-like configurations. The inner ends of the alcoves are connected together at the intersections of the portions of the cover that define the alcoves. The outer ends of the alcoves define entrances. A frame assembly is provided for supporting the cover in distended position, and includes arch members attached to the cover at each of the outer ends, a central hub, and upper tubular members connected to the arch members at the apexes thereof and extending radially inward to the central hub. Each alcove has a capacity sufficient to enable two people to sleep therein and the entrance at the outer end of each alcove allows the two people occupying the alcove to enter and leave when desired. The upper members that extend between the arch members and the central hub are bowed upward and these members and the arch members extend through tunnels formed in the flexible cover. When erected the tent has aerodynamic properties enabling it to withstand heavy wind loads. The cover and the frame assembly can be disassembled and transported by one person as part of a back pack, and a tent embodying this invention and which can accommodate six persons will have a weight of approximately 13 lbs.

The tent includes other desirable features such as a bottom wall with a cook hole centrally located, and a vent hole is provided in the top of the cover for ventillation purposes. A detachable closure is provided for closing the vent opening, when desired. Similarly, closure members are provided at the entrances which can be screens or imperforate sheets, if desired. Also, the frame assembly is constructed and arranged so that a suitable overhang, or canopy, can be provided at the entrances by utilizing the detachable closure.

Thus, it is an object of the present invention to provide an improved portable shelter, specially adapted for group camping.

Other objects of this invention will appear in the following description and appended claims, reference being had to the accompanying drawings forming a part of this specification wherein like reference characters designate corresponding parts in the several views.

DESCRIPTION OF THE PREFERRED EMBODIMENT

Figure 1:
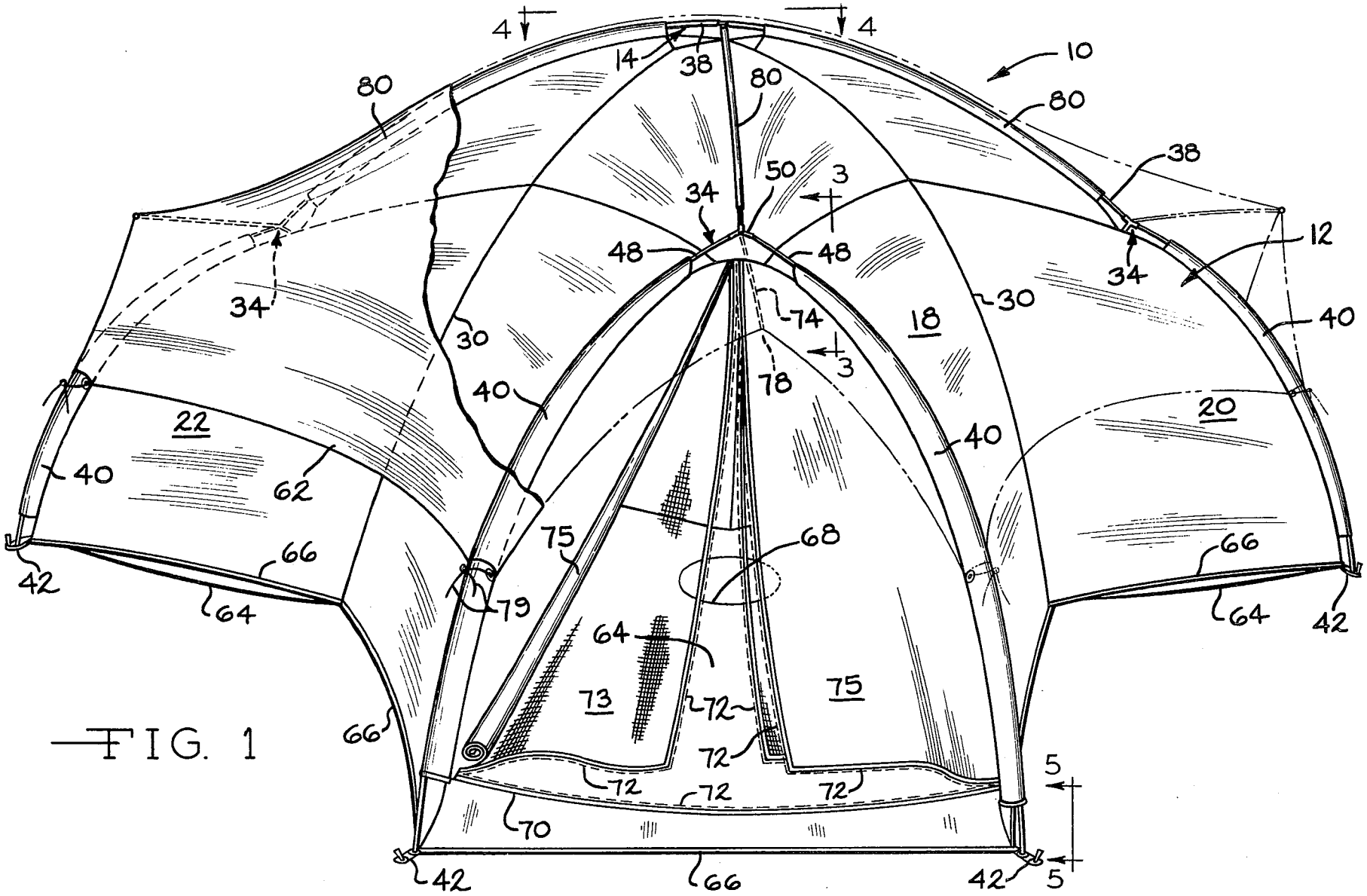
FIG. 1 is a front perspective view of a portable shelter embodying the present invention with a detachable closure shown partly in solid lines and partly in broken lines.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The tent or portable shelter 10 comprises the flexible cover 12 which is supported on the frame assembly 14.

Figure 2:
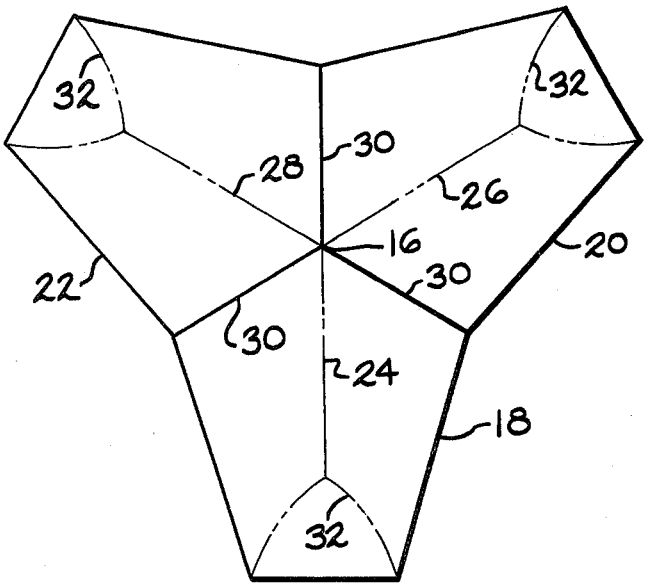
FIG. 2 is a schematic top plan view of the portable shelter.

The flexible cover 12 has a centrally located vertical axis 16 and defines, when extended, three alcoves 18, 20, and 22. As can be seen best in the schematic illustration in FIG. 2, the three alcoves are disposed radially around the vertical axis 16 and have longitudinal axes 24, 26, and 28, which intersect the vertical axis 16. As seen with reference to alcove 18, each of the alcoves has arch-like configurations in transverse cross sections. The inner ends 30 of the portions of the cover 12 that define the alcoves 18, 20, and 22 are joined together, and the outer ends 32 of the alcoves define separate entrances.

The frame assembly 14 includes arch members 34 attached to the cover 12 at each of the outer ends of the alcoves 18, 20, and 22. The frame assembly 14 also includes the central hub 36 and the tubular compression or upper members 38, which are connected respectively to the arch members 34 at the apexes thereof and extend radially inwardly therefrom to the central hub 36. The central hub 36 is located at the vertical axis 16, and the upper members 38 are relatively rigid upwardly bowed elements which are in vertical planes containing the longitudinal axes 24, 26, and 28 and are attached to the cover 12 in these planes.

Figure 3:
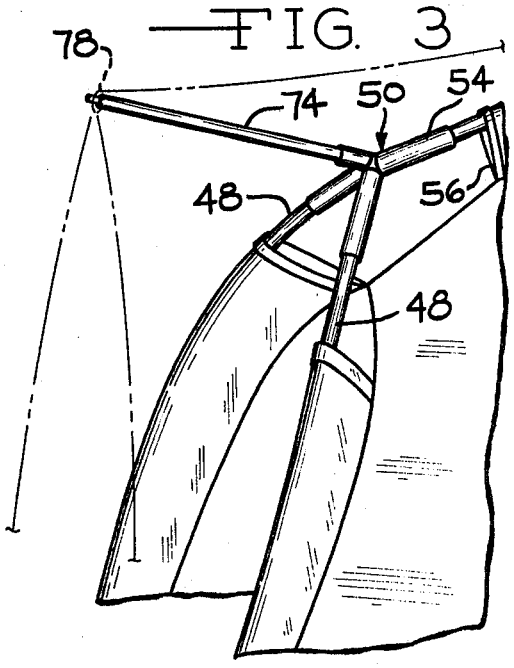
FIG. 3 is an enlarged fragmentary side perspective view taken on the lines 3—3 of FIG. 1 showing the detachable closure in broken lines.
Figure 5:
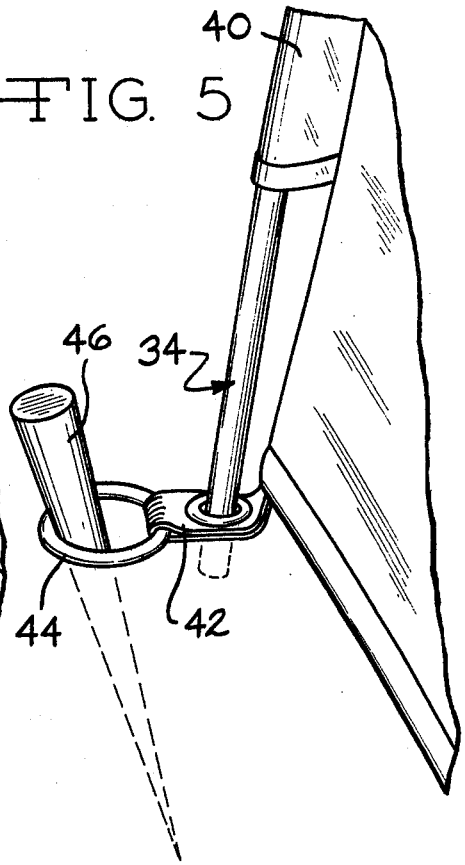
FIG. 5 is an enlarged perspective view taken in the direction of the lines 5—5 of FIG. 1.

For attachment purposes, the flexible cover 12 is formed with tunnels 40 through which the arch members 34 are fitted. The cover also has fastening means 42 into which the lower ends of the arch members 34 can be inserted and which include the rings 44 for receiving staking pins 46, as shown in FIG. 5. Each arch member 34 includes at least two flexible fiber glass rods 48, which are secured together at the apex of the arch member 34 by the interconnecting means 50. As shown in FIG. 3, the interconnecting means 50 is a rigid member which has a plurality of radiating arms or sockets 52 for receiving the upper ends of the rods 48. The radiating arm 54 may have either a pin or a socket at its end which is adapted to receive the end of the tubular upper member 38 to provide a rigid telescopic connection.

Figure 4:
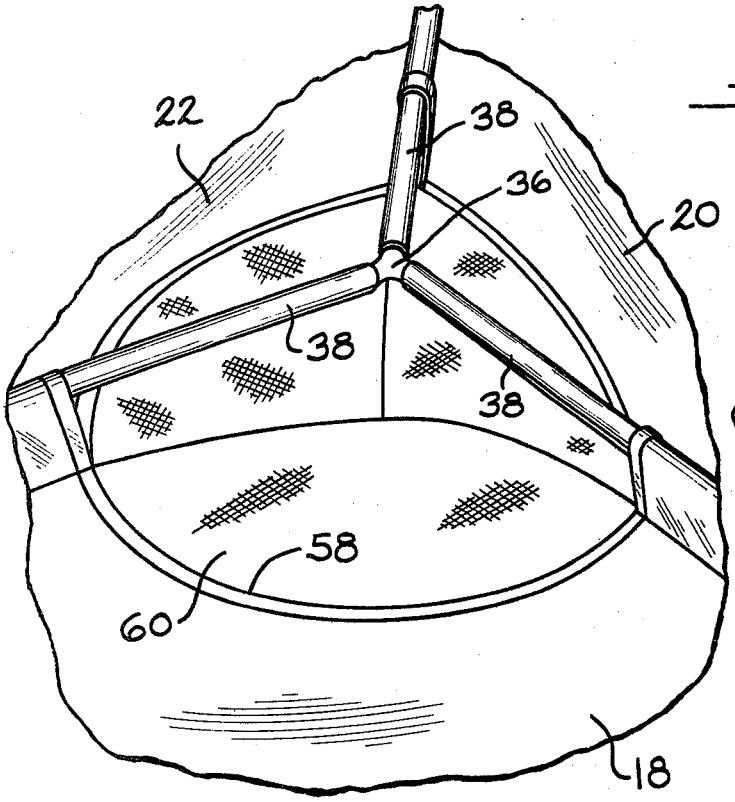
FIG. 4 is a fragmentary top perspective view taken in the direction of the lines 4—4 of FIG. 1 with the detachable closure removed.

Referring to FIG. 4, it will be seen that the upper and inner ends of the cover portions that define the alcoves 18, 20, and 22, provide an opening 58 for ventillation purposes, and a screen 60 is secured to the edges to prevent insects and the like from entering the tent 10 at this location. One of the purposes of the ventiallation opening 58 is to permit cooking within the tent. As shown in FIG. 1, a detachable closure sheet or member 62 is provided for keeping rain and the like, out of the tent 10 when cooking operations are not in progress, as well as for overhangs or canopies at each of the entrances, as will be described.

The tent 10 is also provided with a flexible bottom wall 64 which is secured to the lower edges 66 of the alcoves 18, 20, and 22. The bottom wall is provided with a cook hole 68, which is located invertical alignment with the vent opening 58. Each of the alcoves 18, 20, and 22 is provided with a flexible closure 70 at its respective entrance, and each closure has a double slide zipper 72 for securing the closure when desired. The closure includes both a screen 73 for ventillation purposes and an impervious weather-proof sheet 75.

As shown with respect to the alcove 18, the frame assembly may include a flexible fiber glass overhang rod 74, which is fitted into the open end of the socket or radial arm 76 of the interconnecting means 50 and extends outwardly as an extension from its tubular upper member 38 in an overhanging relation with respect to the entrance of the alcove 18. The outer end of the overhang rod 74 extends through the grommet 78 in the seam of the closure member 78 so that the latter is supported on the rod 74 to provide a canopy for the entrance. The closure member 62 has cords 79 which are tied through the grommets 81 in the tunnels 40 for securing the closure member 62 in place.

As can be seen best in FIG. 1, the upper members 38 flexible tubular members which, when the tent 10 is erected, are bowed into a state of compression and these members together with the arch members 34 are held in a state of compression within the tunnels 40 and 80, and thereby the cover 12 is also distended in a state of tension by the frame assembly 14. Thus, a completely freestanding, vaulted pole system is provided which has aerodynamic properties which deflect heavy wind loads while providing a spacious interior for six campers. Ingress and egress for each of the six campers is readily available. If desired, more than three alcoves can be included, and it will also be understood that the various rods and tube members can be formed in detachable sections joined by ferrules and the like to shorten their lengths, when disassembled. When disassembled, the disclosed embodiment of the invention can be readily transported by one individual as part of his back pack.

It is claimed:

1. A portable shelter comprising a flexible cover having a centrally located vertical axis and defining when distended at least three disposed radially around said vertical axis, said alcoves having longitudinal axes intersecting said vertical axis and transverse cross sections of arch-like configurations and having configurations so that each alcove defines a living space communicating with the living spaces of the other alcoves only at its longitudinal inner end, the inner ends of said alcoves being connected together at the intersections of portions of the cover defining the alcoves, the outer ends of said alcoves defining entrances so that each alcove is provided at its longitudinal outer end with a private entrance, and a frame assembly for supporting said cover in distended position, said frame assembly including arch members and attached to said cover at each of said outer ends, a central hub, and upper members connected to said arch members at the apexes thereof and extending radially inward to said central hub located at said vertical axis, said upper members being in vertical planes containing said longitudinal axes and being attached to said cover in these planes.

2. The portable shelter that is defined in claim 1, wherein said flexible cover includes a bottom wall integrally joined to the bottom edges of said portions of the cover, said bottom wall having a cook-hole centrally located at said vertical axis, and the radially inner edges of said portions defining a vent opening above said cook-hole.

3. The portable shelter that is defined in claim 2, wherein a flexible screen is attached to said radially inner edges and extends accross said vent opening, and a detachable closure is provided for closing said vent opening.

4. The portable shelter that is defined in claim 1, wherein said cover has tunnels on its exterior through which said arch members and said upper members extend whereby the cover is connected to said frame assembly.

5. The portable shelter that is defined in claim 4, wherein said frame assembly is held in a state of compression within the confines of said tunnels and said cover is distended in a state of tension by said frame assembly.

6. The portable shelter that is defined in claim 4, wherein said cover has attachment means at its bottom edges adjacent to the outer ends of said alcoves, and each of said arch members has its ends retained in associated pairs of said attachment means.

7. The portable shelter that is defined in claim 6, wherein said frame assembly has interconnecting means for rigidly connecting each of said arch members with the outer end of an associated one of said upper members, and the tunnels for said arch members and the tunnels for said upper members terminate adjacent to said interconnecting means.

8. The portable shelter that is defined in claim 7, wherein each of said interconnecting means is a rigid member having radiating arms, and each of said arch members includes resilient rods telescopically connected at upper ends to a pair of said radiating arms.

9. The portable shelter that is defined in claim 8, wherein each of said interconnecting means has a radiating arm telescopically connected to the outer end of an associated one of said upper members.

10. The portable shelter that is defined in claim 9, wherein said upper members are tubular aluminum members that are releasably connected to said hub.

11. The portable shelter that is defined in claim 10, wherein said resilient rods are fiberglass rods releasably connected to their radiating arms.

12. The portable shelter that is defined in claim 1, wherein said cover has a flexible closure at the outer end of each of said alcoves.

13. The portable shelter that is defined in claim 12, wherein said frame assembly includes at least one overhang rod connected as a cantilever at its one end to the apex of one of said arch members, and said flexible closure is connected to the outer end of said rod and is supported thereon to provide a canopy for the entrance.

14. The portable shelter that is defined in claim 12, wherein each of said closures has a double slide zipper for opening and closing the closure.

15. The portable shelter that is defined in claim 14, wherein at least one of said closures is a screen.

* * * * *